United States Patent [19]

Masterson et al.

[11] Patent Number: 4,754,951

[45] Date of Patent: Jul. 5, 1988

[54] TUYERE ASSEMBLY AND POSITIONING METHOD

[75] Inventors: Ian F. Masterson, Danbury, Conn.; Roger Bridgeman, Salt Lake City, Utah; Steven Bailey, Silver City, N. Mex.

[73] Assignee: Union Carbide Corporation, Danbury, Conn.

[21] Appl. No.: 85,625

[22] Filed: Aug. 14, 1987

[51] Int. Cl.[4] ..... C21C 5/48

[52] U.S. Cl. ..... 266/47; 266/218; 266/268; 266/270

[58] Field of Search ..... 266/44, 47, 218, 225, 266/226, 265, 266, 267, 268, 270, 287

[56] References Cited

U.S. PATENT DOCUMENTS

| | | | |
|---|---|---|---|
| 3,495,815 | 2/1970 | Holmes | 266/270 |
| 3,614,083 | 10/1971 | Holmes | 266/270 |
| 3,695,603 | 10/1972 | Walk et al. | 266/218 |
| 3,703,279 | 11/1972 | Saccomano et al. | 266/268 |
| 3,779,534 | 12/1973 | Leroy et al. | 266/268 |
| 3,781,002 | 12/1973 | Courard | 266/268 |
| 3,826,479 | 7/1974 | Ikegawa | 266/270 |
| 4,138,098 | 2/1979 | Leroy | 266/268 |
| 4,258,633 | 3/1981 | Elderfield | 110/182.5 |
| 4,417,723 | 11/1983 | Kitamura et al. | 266/265 |
| 4,424,955 | 1/1984 | Wells | 266/47 |
| 4,434,976 | 3/1984 | Murakami et al. | 266/268 |
| 4,449,701 | 5/1984 | Pitzer et al. | 266/218 |
| 4,462,824 | 7/1984 | Nauman | 266/218 |
| 4,657,586 | 4/1987 | Masterson et al. | 75/76 |

FOREIGN PATENT DOCUMENTS

| | | | |
|---|---|---|---|
| 2051676 | 1/1973 | Fed. Rep. of Germany | 266/267 |

OTHER PUBLICATIONS

AOD Tuyeres, Union Carbide Corporation, Linde Division Sep., 1980.

*Primary Examiner*—L. Dewayne Rutledge
*Assistant Examiner*—Robert L. McDowell
*Attorney, Agent, or Firm*—Stanley Ktorides

[57] ABSTRACT

A tuyere assembly and positioning method comprising mechanically separate or separable inner and outer tubes, the inner tube(s) being removeable and replaceable and the outer tube being extendable into a vessel and held in place by a flared end abutting the wall of a cavity through the vessel wall.

15 Claims, 2 Drawing Sheets

TUYERE ASSEMBLY AND POSITIONING METHOD

TECHNICAL FIELD

The invention relates generally to tuyeres for submerged injection of fluids such as gases into molten material and in particular is an improved tuyere assembly and method useful with the recently developed submerged melting and refining process.

BACKGROUND ART

A recent very significant advance in the field of heating, melting and refining material is the submerged melting and refining process disclosed and claimed in U.S. Pat. No. 4,657,586—Masterson et al. This process is directed to heating certain molten material, e.g. nonferrous material such as copper, and optionally melting said material, or to refining copper, by the submerged injection into the material of oxygen and a fluid fuel wherein the fuel is injected in much higher stoichiometric amounts than in conventional submerged injection processes, and wherein fuel serves to form a shroud around the injected oxygen. Optionally an inert gas such as nitrogen is employed such as in a process step when heating is not necessary. One such process step is degassing wherein the molten bath is stirred with an inert gas.

When the refining gases are employed in the aforesaid submerged melting and refining process, the tuyere wear rate limits the life of the tuyere and the surrounding refractory. It is desirable, therefore, to have a tuyere useful with the submerged melting and refining process which exhibits a decreased wear rate over heretofore available tuyeres.

Accordingly, it is an object of this invention to provide a tuyere assembly useful with the submerged melting and refining process which exhibits a decreased wear rate over heretofore available tuyeres.

It is another object of this invention to provide a method for positioning a tuyere within a vessel so as to extend the life of the tuyere.

SUMMARY OF THE INVENTION

The above and other objects which will become apparent to one skilled in the art upon reading of this disclosure are attained by the present invention one aspect of which is:

A tuyere assembly comprising:

(A) at least one inner tube oriented within a cavity through the wall of a vessel, extending outward beyond both the inner surface and the outer surface of said wall; and (B) an outer tube oriented within said cavity, concentric to and mechanically separate or separable from said inner tube(s), extending from outward beyond the inner surface of said wall to a point within the cavity short of the wall outer surface, thereat having a flared end angularly contacting the cavity inner surface.

Another aspect of the invention is:

A method for positioning a tuyere within a vessel so as to extend the life of said tuyere comprising:

(A) providing a tuyere assembly comprising:

(a) at least one inner tube oriented within a cavity through the wall of a vessel, extending outward beyond both the inner surface and the outer surface of said wall; and (b) an outer tube oriented within said cavity, concentric to and mechanically separate or separable from said inner tube(s), extending from outward beyond the inner surface of said wall to a point within the cavity short of the wall outer surface, thereat having a flared end angularly contacting the cavity inner surface;

(B) removing the inner tube(s) from the cavity;

(C) moving the outer tube to extend further outward beyond the inner surface of said wall; and (D) inserting inner tube(s) within the cavity so as to extend beyond the inner surface to about the point where the outer tube extends.

BRIEF DESCRIPTION OF THE DRAWINGS

FIG. 1 is a partial cut-away view of a copper anode refining furnace which the tuyere assembly of this invention may be employed in conjunction with.

DETAILED DESCRIPTION

The present invention may be practiced in conjunction with any suitable vessel for containing and treating molten materials. One such vessel is a copper anode refining furnace such as is illustrated in FIG. 1.

Figure 1:
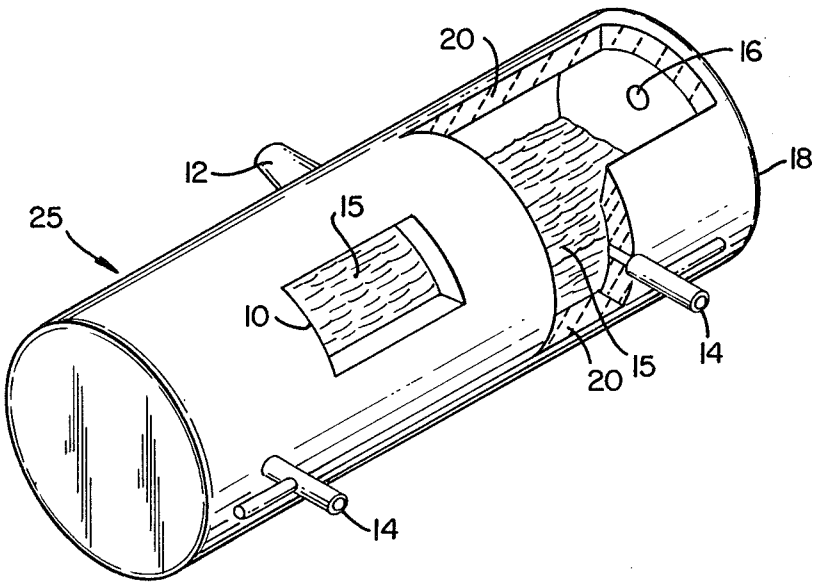

Referring now to FIG. 1, anode furnace 25 has a mouth 10 for charging material and a tap hole 12 through which processed material can be removed. One or more tuyeres 14 are located in the wall of the vessel for subsurface injection of fluids into the molten bath 15. Burner 16 is mounted in end wall 18 for addition of heat. Furnace 25 is lined with refractory material 20.

Figure 2:
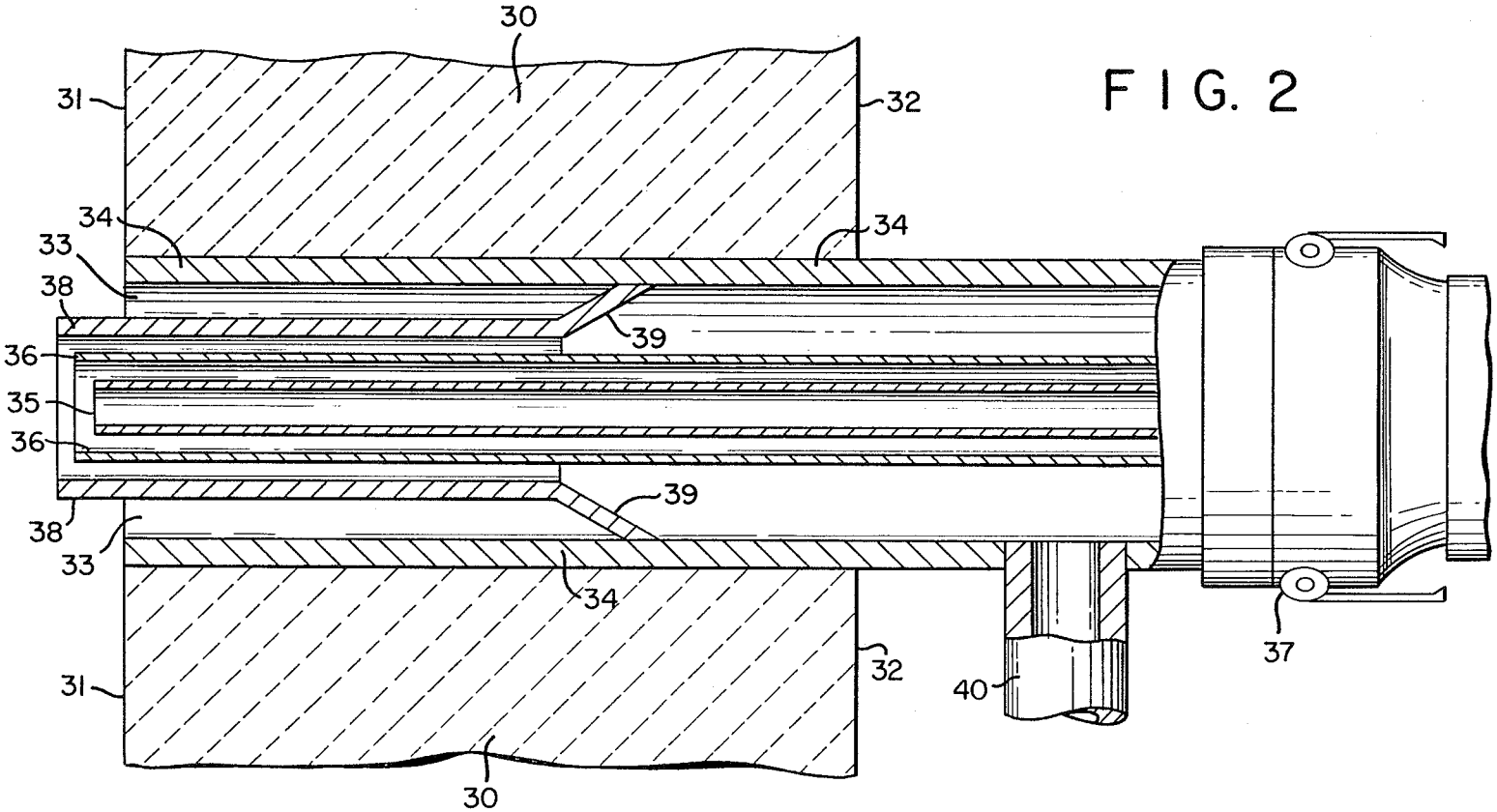
FIG. 2 is a cross-sectional view of one preferred embodiment of the tuyere assembly of this invention.

FIG. 2 is a cross-sectional view of one preferred embodiment of the tuyere assembly of this invention such as might be used as tuyere(s) 14 in the anode furnace illustrated in FIG. 1.

Referring now to FIG. 2, vessel wall 30 has inner surface 31, outer surface 32 and cavity 33 therethrough between the inner and outer surfaces. Preferably cavity 33 is cylindrical having a diameter within the range of from 0.5 to 4.0 inches. Preferably cavity 33 has a lined inner surface 34. The lining may be any suitable refractory or metallic material; preferably the lining is metallic.

Within cavity 33 is oriented one or more inner tubes. FIG. 2 illustrates a preferred embodiment wherein a central tube 35 and a concentric tube 36 are the inner tubes of the tuyere assembly. Inner tubes 35 and 36 are connected to sources of fluids, e.g. gases, through coupling means 37. Inner tubes 35 and 36 extend outward beyond both inner surface 31 and outer surface 32 of vessel wall 30. That is, the inner tubes extend into the vessel as well as out past the vessel wall.

Also oriented within cavity 33 is outer tube 38 which is concentric to inner tubes 35 and 36. Preferably both the inner tube(s) and the outer tube are generally cylindrical in shape. Outer tube 38 also extends outward beyond inner surface 31 into the vessel. However the other end of outer tube 38 does not extend to the wall outer surface but rather extends to a point short of the wall outer surface. At that point outer tube 38 has a flared end 39 which angularly contacts cavity inner surface 34 so as to secure outer tube 38 in place by the outwardly thrusting force circumferentially around the cavity inner surface. As such, outer wall 38 is mechanically separate or separable from inner tubes 35 and 36.

Flared end 39 contacts cavity inner surface 34 at any suitable angle. Preferably flared end 39 contacts cavity inner surface 34 at an angle within the range of from 10 to 30 degrees; however, the contact angle may be up to 90 degrees or more.

Fluid, such as gas, passes through conduit 40, into outer tube 38 and then into the refining vessel. Flared end 39 constrains this gas from flowing into the vessel outside of outer tube 38.

While not wishing to be held to any theory, applicants surmise that the high tuyere wear rate heretofore experienced is caused by the formation of solidified material at the injection end of the tuyere. The formation of solidified material is generally greater when an inert gas, such as nitrogen, or a cooling gas, such as a fluid fuel gas, is employed. The solidified material causes a significant amount of injected fluid to be blown back onto the tuyere and onto the adjacent inner surface refractory. This blow back of fluid, such as gases, causes severe wear to the refractory and causes the tuyere length within the wall to wear out prematurely. Accordingly applicants recognized that a solution to the problem of high tuyere wear rate is to maintain the tuyere injection end, where the solidified material forms, a significant distance from the vessel wall inner surface, so that the resulting blow back of gases impinges to a much lesser extent on the vessel wall. Preferably the tuyere injection end is maintained not less than one inch from the vessel wall inner surface.

The present invention enables one to easily maintain a sufficient distance between the tuyere injection end and the vessel wall to keep gas blow back from prematurely wearing out the wall and tuyere, without need to change the entire tuyere every time the injection end is worn to within a close distance of the vessel wall.

When the tuyere injection end has worn to a point where the distance between the injection end of the wall inner surface is such that blow back may cause significant damage to the vessel wall, further material processing. e.g. metal refining, is temporarily halted. The inner tubes are removed such as by disengaging coupling means 37. Since the inner and outer tubes are not mechanically connected, outer tube 38 remains in place. With the inner tubes removed, outer tube 38 is moved so as to extend further outward beyond inner surface 31 so as to extend past the point where gas blow back might cause refractory wall wear problems. Any effective way to move outer tube 38 along cavity 33 may be used. One way found particularly effective by applicants is to place a cylindrical or other hammerable piece into cavity 33 to contact outer tube 38 at the flared end, and then to hammer on the hammerable piece so as to pass the hammering force onto outer tube 38. Flared end 39 is set against cavity inner surface 34 but is not connected thereto. Accordingly the hammering force causes outer tube 38 to move along cavity 33 while flared end 39 maintains contact with cavity inner surface 34 to ensure that outer tube 38 is secured in place. Thereafter the inner tube or tubes are inserted within the cavity so that their ends extend to about the same point where the outer tube end extends. The same inner tube or tubes which were removed could be reinserted or a different inner tube or tubes may be inserted.

Material processing may then be resumed until the tuyere has again worn to a point where the distance between the injection end and the wall inner surface is such that blow back may cause significant damage so the vessel wall, whereupon the positioning method is repeated. The positioning method of this invention may be repeated until substantially the entire effective length of the outer tube is worn away, at which time the outer tube is replaced.

The following Example is reported to further illustrate the invention. The Example is reported for illustrative purposes and is not intended to be limiting.

EXAMPLE

Blister copper was refined in a nominal 350 ton anode furnace measuring 13 feet by 45 feet similar to that illustrated in FIG. 1. Two double-shrouded tuyere assemblies of the invention, of a design similar to that illustrated in FIG. 2, were simultaneously employed to inject fluids into the copper. The copper was refined in a two step process; the first step for sulfur removal and the second step for oxygen removal. The gas flowrates, in cubic feet per minute, for the two steps are reported in Table I.

TABLE I

| | Oxygen | Nitrogen | Fuel Gas |
|---|---|---|---|
| Step 1 | 200 | 400 | 124 |
| Step 2 | 300 | 200 | 450 |

Approximately 1200 charges of copper were refined. The average charge weight was 235 tons and the average refining time was 135 minutes per charge. The outer tube of the tuyere assembly was moved about one inch into the furnace every 10–12 hours of refining time in accord with the positioning method of the invention. Over the course of the refining of the 1200 charges, the tuyere assemblies of the invention exhibited an average life of about 300 refining hours before replacement was necessary, and had an average wear rate of 0.03 inch per refining hour.

COMPARATIVE EXAMPLE

For comparative purpose this Comparative Example is also reported.

Employing the same anode furnace as used in the Example, and employing a procedure similar to that reported in the Example, 500 charges of blister copper were refined by injecting the fluids into the copper through two double shrouded tuyere assemblies of conventional design. The conventional tuyere assemblies had an outer tube which was not separable from the inner tubes and did not have a flared end. The charges had an average weight of 332 tons and the average refining time was 180 minutes per charge. Over the course of the refining of the 500 charges, the conventional tuyere assemblies exhibited an average life of about only 80 refining hours before replacement was necessary, and had an average wear rate exceeding 0.10 inch per refining hour.

As is demonstrated by the Example and Comparative Example which report results attained over a large number of refining heats, the tuyere assembly and tuyere positioning method of this invention enabled an increase in tuyere life over that of conventional tuyeres of an average of 275 percent.

Now by the use of the tuyere assembly and the tuyere positioning method of this invention, one can significantly increase the life of tuyeres used for submerged injection into molten material such as the submerged melting and refining process.

Although the present invention has been described with reference to certain preferred embodiments, it is recognized by those skilled in the art that there are a number of other embodiments of the invention within the spirit and scope of the claims.

We claim:

1. A tuyere assembly comprising:

(A) at least one inner tube oriented within a cavity through the wall of a vessel, extending outward beyond both the inner surface and the outer surface of said wall; and (B) an outer tube oriented within said cavity, concentric to and mechanically separate or separable from said inner tube(s), extending from outward beyond the inner surface of said wall to a point within the cavity short of the wall outer surface, thereat having a flared end angularly contacting the cavity inner surface.

2. The tuyere assembly of claim 1 having a single inner tube.

3. The tuyere assembly of claim 1 having two inner tubes.

4. The tuyere assembly of claim 3 wherein the inner tubes are concentric to each other.

5. The tuyere assembly of claim 1 wherein the cavity is cylindrical having a diameter within the range of from 0.5 to 4.0 inches.

6. The tuyere assembly of claim 1 wherein the flared end of the outer tube contacts the cavity inner surface at an angle within the range of from 10 to 90 degrees.

7. The tuyere assembly of claim 1 wherein the flared end of the outer tube contacts the cavity inner surface at an angle within the range of from 10 to 30 degrees.

8. The tuyere assembly of claim 1 wherein the inner tube(s) and the outer tube extend outward beyond the wall inner surface by at least one inch.

9. The tuyere assembly of claim 1 wherein both the inner tube(s) and the outer tube are generally cylindrical in shape.

10. The tuyere assembly of claim 1 wherein the vessel is a copper anode refining furnace.

11. A method for positioning a tuyere within a vessel so as to extend the life of said tuyere comprising:

(A) providing a tuyere assembly comprising:

(a) at least one inner tube oriented within a cavity through the wall of a vessel, extending outward beyond both the inner surface and the outer surface of said wall; and (b) an outer tube oriented within said cavity, concentric to and mechanically separate or separable from said inner tube(s), extending from outward beyond the inner surface of said wall to a point within the cavity short of the wall outer surface, thereat having a flared end angularly contacting the cavity inner surface;

(B) removing the inner tube(s) from the cavity;

(C) moving the outer tube to extend further outward beyond the inner surface of said wall; and (D) inserting inner tube(s) within the cavity so as to extend beyond the inner surface to about the point where the outer tube extends.

12. The method of claim 11 wherein the inner tube(s) removed in step (B) are employed in the insertion of step (D).

13. The method of claim 11 wherein the inner tube(s) inserted in step (D) differ from the inner tube(s) removed in step (B).

14. The method of claim 11 wherein steps (B)-(D) are periodically repeated so as to maintain the tuyere injection end at least one inch from the wall inner surface.

15. The method of claim 11 wherein step (C) is carried out by contacting the flared end with a hammerable piece and hammering on the hammerable piece to pass hammering force onto the outer tube.

* * * * *